US009673011B2

(12) United States Patent
Hsu

(10) Patent No.: US 9,673,011 B2
(45) Date of Patent: Jun. 6, 2017

(54) HIGH AND ULTRA-HIGH VOLTAGE CIRCUIT BREAKING SYSTEM

(71) Applicant: LONG MEN TECHNOLOGY CO., LTD., New Taipei (TW)

(72) Inventor: Lai-Wang Hsu, New Taipei (TW)

(73) Assignee: LONG MEN TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 14/926,000

(22) Filed: Oct. 29, 2015

(65) Prior Publication Data

US 2017/0125194 A1 May 4, 2017

(51) Int. Cl.

| | |
|---|---|
| ***H01H 75/02*** | (2006.01) |
| ***H01H 61/01*** | (2006.01) |
| ***H01H 81/02*** | (2006.01) |
| ***H01H 73/02*** | (2006.01) |

(52) U.S. Cl.

CPC ..... *H01H 61/01* (2013.01); *H01H 73/02* (2013.01); *H01H 75/02* (2013.01); *H01H 81/02* (2013.01); *H01H 2239/044* (2013.01)

(58) Field of Classification Search

CPC .. H01H 61/01; H01H 2239/044; H01H 75/02; H01H 73/02; H01H 81/02

USPC ..... 337/115

See application file for complete search history.

(56) References Cited

U.S. PATENT DOCUMENTS 2,276,668 A * 3/1942 Parsons ..... H02J 3/42 361/60
2,280,899 A * 4/1942 Dyer ..... H02H 3/24 307/141
2,329,096 A * 9/1943 Witzke ..... H02H 9/08 307/105
2,393,043 A * 1/1946 Harder ..... G01R 19/0038 322/28
2,846,633 A * 8/1958 Gingrich ..... H02P 29/40 318/434
2,947,958 A * 8/1960 Marks ..... H02H 7/042 29/602.1
3,277,344 A * 10/1966 Mathews ..... H02H 7/262 361/81
3,818,275 A * 6/1974 Shimp ..... H02H 3/093 361/100
3,924,160 A * 12/1975 Maier ..... H02H 3/044 324/424
4,017,698 A * 4/1977 Kuhn ..... H02B 11/133 200/50.21
4,352,138 A * 9/1982 Gilker ..... H02H 1/06 361/92
4,935,715 A * 6/1990 Popeck ..... H01H 71/123 337/169

(Continued)

*Primary Examiner* — Anatoly Vortman
(74) *Attorney, Agent, or Firm* — Leong C. Lei

(57) ABSTRACT

The circuit breaking system contains a power circuit whose voltage is greater than 600 volts, at least a circuit breaking device, at least a current detection device, a current reduction unit, at least an actuation device, and a linking device. The circuit breaking system is applicable to a high or ultra-high voltage power circuit, and the power circuit is interrupted through purely mechanical means without additional electricity provision. Even when there are major disasters that existing protection means fails, the present invention can still function and provides a trip free, ultimate self-protection mechanism so that a power system can be readily reset.

9 Claims, 3 Drawing Sheets

(56) References Cited

U.S. PATENT DOCUMENTS

| | | | | |
|---|---|---|---|---|
| 6,137,386 | A * | 10/2000 | Mueller | H01H 71/164<br>335/167 |
| 6,876,532 | B2 * | 4/2005 | Engel | H02H 3/085<br>361/103 |
| 2003/0223167 | A1 * | 12/2003 | Udren | H02H 3/28<br>361/65 |
| 2005/0018371 | A1 * | 1/2005 | Mladenik | H02H 3/00<br>361/78 |

* cited by examiner

HIGH AND ULTRA-HIGH VOLTAGE CIRCUIT BREAKING SYSTEM

BACKGROUND OF THE INVENTION (a) Technical Field of the Invention

The present invention is generally related to circuit breakers, and more particular to a circuit breaking system providing over-current protection for a power circuit of high or ultra-high voltage without additional electricity provision.

(b) Description of the Prior Art

Circuit breaker is a device having an over-current protection function, and is usually applied to a main switch or a branch switch of in-house wiring, or serving as a vital component for appliance protection. Its main purpose is for short-circuit protection and for preventing overloading. Motors for industrial apparatus also require circuit breakers as a protection means. These circuit breakers are usually applied to low voltage circuits below 600 volts.

Circuit breakers for high or ultra-high voltage usually involve an electronic automatic protection mechanism that, when an extra-large current or extra-high voltage is detected, power provision is immediately cut off, or an input current or voltage is directly limited, so as to prevent apparatus damage from the extra-large or extra-high current or voltage.

However, the above circuit breakers have the following drawbacks.

Firstly, most circuit breakers are applicable to low voltage circuits only, and their applicability is therefore limited.

Secondly, for those suitable for high or ultra-high voltage circuits, additional electricity provision is usually required so as to sustain the operation of the electronic automatic protection mechanism.

Thirdly, disaster or accident sometimes would disrupt the additional electricity provision and as such the circuit breaker fails to complete the circuit breaking operation, thereby burning down the circuit breaker itself and downstream equipment.

SUMMARY OF THE INVENTION

A major objective of the present invention is to provide a circuit breaking system that is applicable to a high or ultra-high voltage power circuit and operable such that in major disaster such as earthquake that knocks down a transmission tower and causes short circuits or grounding anomalies, the high or ultra-high voltage power circuit is interrupted through purely mechanical means without additional electricity provision. As such, the circuit breaking system and the high or ultra-high voltage power circuit are prevented from being burned down.

Another major objective of the present invention is to incorporate a manual breaking device in the circuit breaking system to allow human manual involvement as a last resort when a power system undergoes total collapse and all other protection means fail.

To achieve the above objectives, the circuit breaking system contains a power circuit whose voltage is greater than 600 volts, at least a current detection device arranged in the power circuit and comprising a current reduction unit, at least a circuit breaking device arranged in the power circuit and electrically connected to the current detection device for selectively opening the power circuit, at least an actuation device electrically connected to the current detection device to engage the circuit breaking device to open the power circuit through a linking device when an output current from the current reduction unit exceeds a preset value, the linking device being arranged in the vicinity of the circuit breaking device, and a manual breaking device connected to the linking device for manually controlling the linking device to engage the circuit breaking device. When the circuit breaking system is applied to a high or ultra-high voltage power circuit, the current detection device is powered by the power circuit and a reduced output current is provided to the actuation device by the current reduction unit. Normally, the actuation device is in a stand-by mode but, when an anomaly occurs in the power circuit so that a current surge causes the output current to exceed the preset value of the actuation device, the actuation device engages the linking device to mechanically drive the circuit breaking device to open the power circuit. Alternatively, the manual breaking device is operated manually to engage the linking device to mechanically drive the circuit breaking device to open the power circuit. As described, over-loading protection to the high or ultra-high voltage power circuit is thereby achieved.

The present invention resolves problems of the prior art such as complicated structure, higher cost, the requirement of additional electricity provision, and the lack of applicability to high or ultra-high voltage power circuit.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
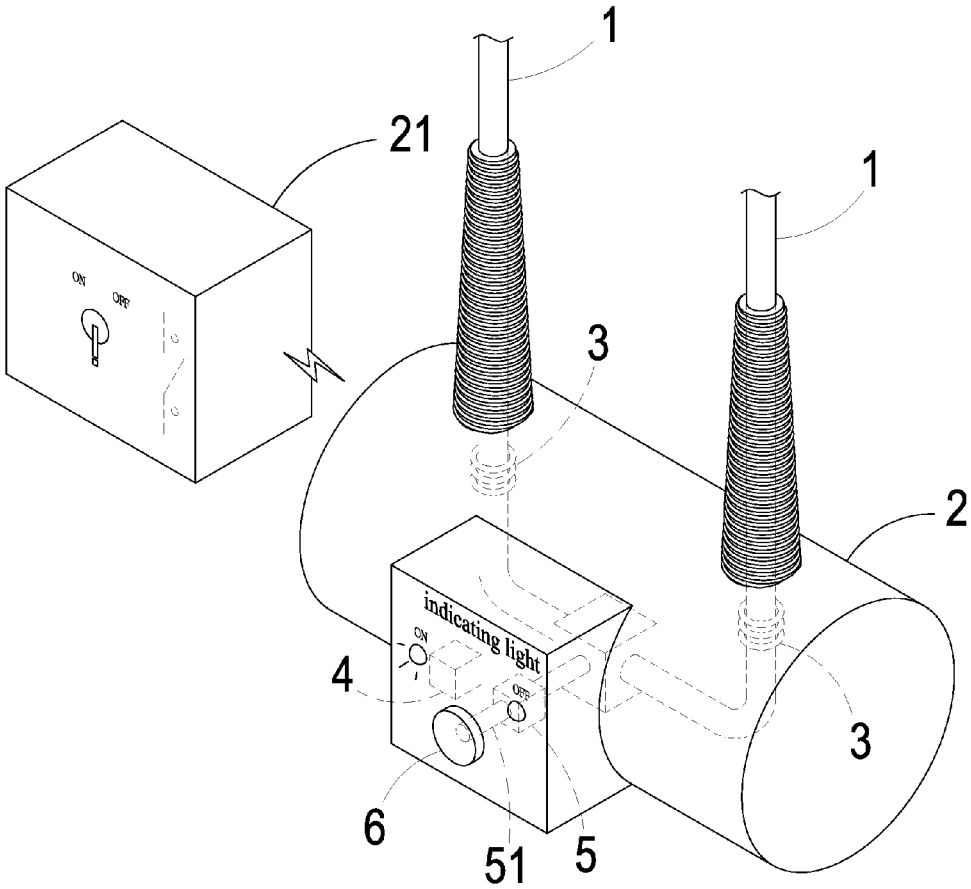
FIG. 1 is a perspective diagram showing a circuit breaking system in a single phase power circuit according to the present invention.
Figure 2:
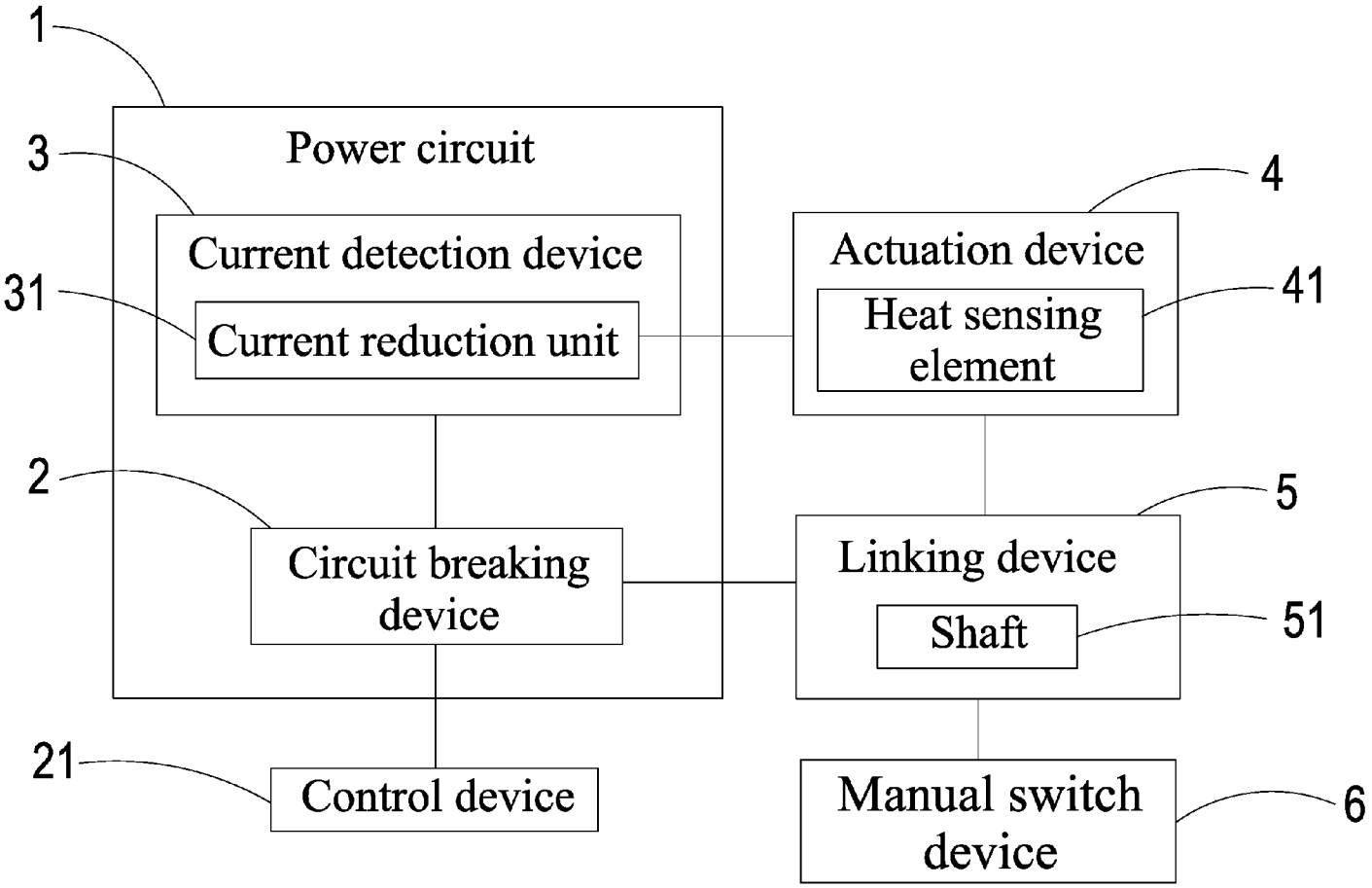
FIG. 2 is a functional block diagram showing a circuit breaking system according to the present invention.

As shown in FIGS. 1 and 2, a circuit breaking system according to the present invention contains the following components.

There is a power circuit 1 whose voltage is between 600 and 503,000 volts.

A current detection device 3, such as a current transformer (CT), is configured in the power circuit 1. The current detection device 3 contains a current reduction unit 31 for providing a reduced output current.

A circuit breaking device 2 is configured in the power circuit 1 and electrically connected to the current detection device 3 for selectively opening (i.e., interrupting) the power circuit 1. The circuit breaking device 2 is connected to a control device 21 so that the circuit breaking device 2 can be remotely controlled.

An actuation device 4 is electrically connected to the current detection device 3. When the output current from the current reduction unit 31 exceeds a preset value of the actuation device 4, the actuation device 4 engages the circuit breaking device 2 through a linking device 5 to open the power circuit 1. On the other hand, the actuation device 4 also contains a heat sensing element 41 which triggers the linking device 5 when accumulated heat causes a change of a parameter, such as expansion of a solid, expansion of a gas, hydraulic pressure, or elasticity, to reach a preset threshold.

The linking device 5 is arranged in the vicinity of the circuit breaking device 2. The linking device 5 contains a shaft 51 for selectively and mechanically driving the circuit breaking device 2.

Figure 3:
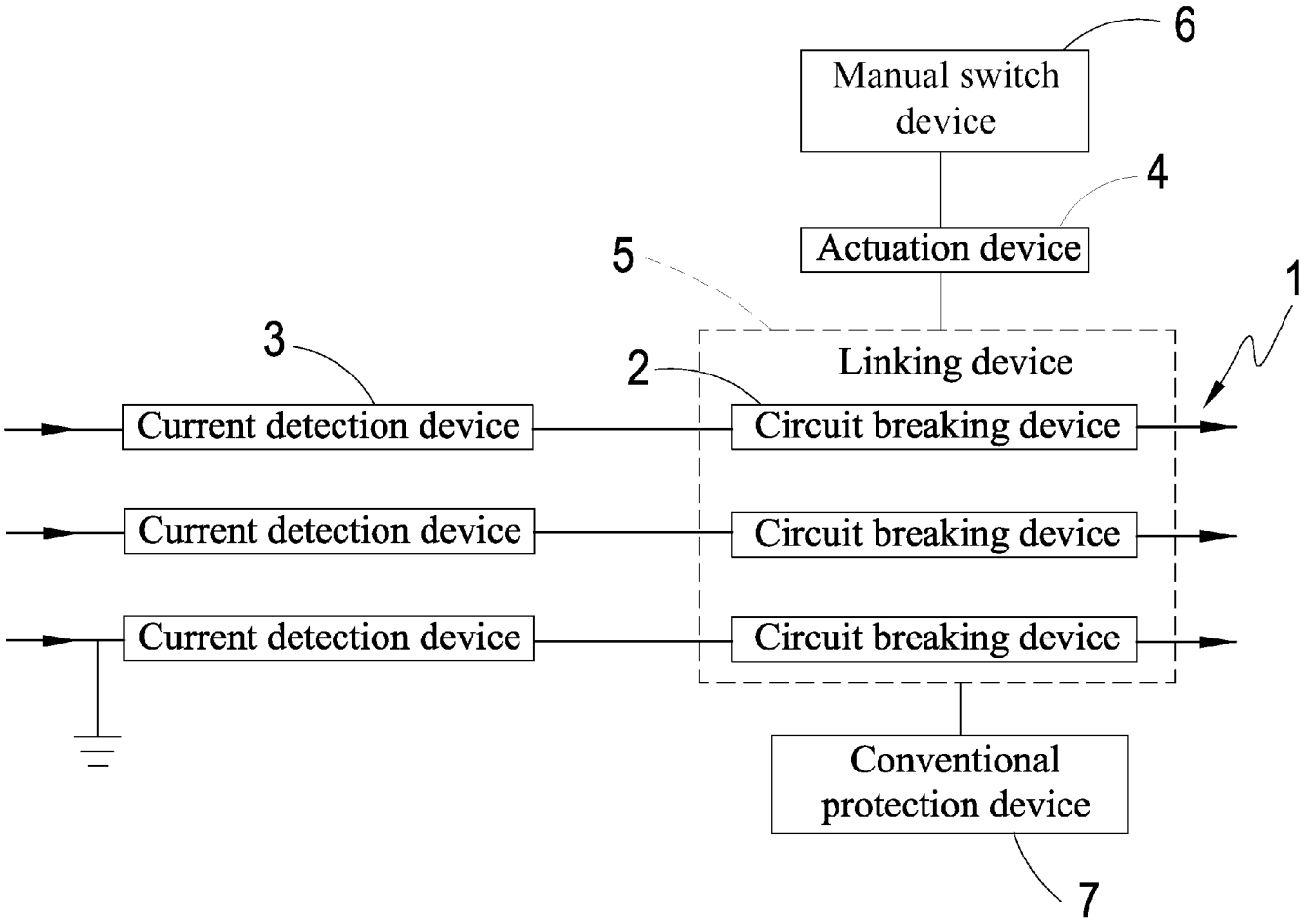
FIG. 3 is a schematic diagram showing a circuit breaking system in a three-phase power circuit according to the present invention.

As shown in FIGS. 1 to 3, the circuit breaking system is applied to high or ultra-high voltage power systems. Generally, high voltage means a voltage between 600 and 10,000 volts, and ultra-high voltage means a voltage above 10,000 volts. These high or ultra-high voltage power systems are usually equipped with automatic safety protection devices and remote control devices 21, and these devices are usually DC- and electronic-based devices that require separate and additional supply of electricity. The circuit breaking system of the present invention, however, does not require additional supply of electricity and, even when major disaster happens, its circuit breaking device 2 can still be functional.

In a high or ultra-high voltage power circuit already equipped with a conventional protection device 7, at least a circuit breaking device 2 and at least a current detection device 3 (current transformer) can be additionally configured. The current reduction unit 31 of the current detection device 3 controls its output current fed to the actuation device 4 so that the output current is normally maintained between 2.5 amperes and 5 amperes. The conventional protection device 7 is capable of providing protection under ordinary circumferences. However, when multiple disasters occur, such as an earthquake that knocks down a transmission tower, and the conventional protection device 7 is damaged by the earthquake, usually the power circuit 1 would fall onto the ground and is thus grounded, and the current would rise multiple times instantly and burn down the power circuit 1. A large amount of heat is produced by the current surge and results in a change of volume. The heat sensing element 41 of the actuation device 4 detects such volume change and, in response, drives the circuit breaking device 2 to open the power circuit 1 through the shaft 51 of the linking device 5 mechanically driving the circuit breaking device 2.

When the power circuit 1 is single-phased, for a power breaking system having multiple sets of current detection devices, circuit breaking devices, etc., the power circuit 1 can be connected to a single set of the components. For a three-phase power circuit 1, each phase can be connected to a single set of the components. Alternatively, when there are three current detection devices, one for each phase, a three-phase circuit breaking device can be used to control all three phases. Or, alternatively, a single linking device 5 can drive the circuit breaking devices 2 of all three phases, as well as the conventional protection device 7, simultaneously so that all three phases can be opened within 50 ms as required by local regulations of some countries. An operator can also manually operate the manual breaking device 6 to open the power circuit 1 through the linking device 5 and the circuit breaking devices 2. In an alternative embodiment, both the actuation device 4 and the manual breaking device 6 can be configured. In summary, the present invention adopts purely mechanical means (i.e., shaft), which is operable, without additional supply of electricity to open a high or ultra-high voltage power circuit so that the high or ultra-high voltage power circuit is prevented from being burned down even when the additional electricity supply has lost.

It should be noted that, even though the circuit breaking system of the present invention is mainly for high or ultra-high voltage power circuits, it is applicable to low voltage (e.g., 480 volts) power circuits as well. And, regardless what original protection mechanism is already equipped, the circuit breaking system of the present invention can be applied as an ultimate protection mechanism so as to ensure the safety of the power system.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A circuit breaking system, comprising:

a power circuit whose voltage is greater than 600 volts;

at least a current detection device in the power circuit where the current detection device comprises a current reduction unit providing a reduced output current;

at least a circuit breaking device in the power circuit electrically connected to the current detection device for selectively opening the power circuit;

a linking device in the vicinity of the circuit breaking device; and at least an actuation device electrically connected to the current detection device where the actuation device engages the circuit breaking device to open the power circuit through the linking device when the output current from the current reduction unit exceeds a preset value of the actuation device;

wherein the actuation device comprises a heat sensing element which causes the actuation device to engage the linking device when accumulated heat results in a change reaching a threshold.

2. The circuit breaking system according to claim 1, wherein the change is one in expansion of a solid, expansion of a gas, hydraulic pressure, and elasticity.

3. The circuit breaking system according to claim 1, wherein the current detection device is a current transformer; and, when there are three current detection devices, the circuit breaking device is a three-phase circuit breaking device.

4. The circuit breaking system according to claim 1, wherein the voltage of the power circuit is between 1 kV and 503 kV.

5. The circuit breaking system according to claim 1, wherein the linking device comprises a shaft for selectively and mechanically driving the circuit breaking device.

6. A circuit breaking system, comprising:

a power circuit whose voltage is greater than 600 volts;

at least a current detection device in the power circuit where the current detection device comprises a current reduction unit;

at least a circuit breaking device in the power circuit electrically connected to the current detection device for selectively opening the power circuit;

a linking device in the vicinity of the circuit breaking device; and at least a manual breaking device connected to the linking device for manually controlling the circuit breaking device to open the power circuit through the linking device;

wherein a remote control device is wirelessly connected with the circuit breaking device to selectively control the circuit breaking device through remote control.

7. The circuit breaking system according to claim 6, wherein the linking device comprises a shaft for selectively and mechanically driving the circuit breaking device.

8. The circuit breaking system according to claim 6, wherein the current detection device is a current transformer; and, when there are three current detection devices, the circuit breaking device is a three-phase circuit breaking device.

9. The circuit breaking system according to claim 6, wherein the voltage of the power circuit is between 1 kV and 503 kV.

* * * * *